US010907779B2

(12) United States Patent
Jackson

(10) Patent No.: US 10,907,779 B2
(45) Date of Patent: Feb. 2, 2021

(54) STRING LIGHT SUPPORT DEVICE FOR PAINTER'S POLE

(71) Applicant: Mark V. Jackson, Sevierville, TN (US)

(72) Inventor: Mark V. Jackson, Sevierville, TN (US)

( * ) Notice: Subject to any disclaimer, the term of this patent is extended or adjusted under 35 U.S.C. 154(b) by 0 days.

(21) Appl. No.: 16/748,008

(22) Filed: Jan. 21, 2020

(65) Prior Publication Data

US 2020/0263841 A1 Aug. 20, 2020

Related U.S. Application Data

(60) Provisional application No. 62/797,675, filed on Jan. 28, 2019.

(51) Int. Cl.

| | |
|---|---|
| ***F21V 21/00*** | (2006.01) |
| ***F21S 4/10*** | (2016.01) |
| *F21W 121/04* | (2006.01) |
| *A47G 33/06* | (2006.01) |

(52) U.S. Cl.

CPC ..... *F21S 4/10* (2016.01); *A47G 33/06* (2013.01); *F21W 2121/04* (2013.01)

(58) Field of Classification Search

CPC ... F21S 10/023; F21S 4/15; F21S 4/10; A47G 2033/0827; A47G 33/06; A47G 33/08; A47G 33/10; A47G 33/0863; F21W 221/04; F21Y 2115/10; F21V 21/008; F21V 21/00; F21V 21/0816; F21V 21/08

USPC .... 362/249.14, 249.16, 249.18, 249.19, 122, 362/123, 391, 395, 396, 431, 644, 806, 362/808

See application file for complete search history.

(56) References Cited

U.S. PATENT DOCUMENTS

| | | | | |
|---|---|---|---|---|
| 3,704,366 | A | 11/1972 | Korb et al. | |
| 4,620,270 | A | 10/1986 | Laakso | |
| 4,720,773 | A | 1/1988 | Ahroni | |
| 5,094,893 | A | 3/1992 | Snider | |
| 5,359,502 | A | 10/1994 | Cantin | |
| 5,523,130 | A * | 6/1996 | Sullivan | A47G 33/0863 428/19 |
| 5,942,294 | A | 8/1999 | Heim | |
| 6,001,435 | A | 12/1999 | Hardy et al. | |
| 6,027,228 | A | 2/2000 | Adams et al. | |
| 6,050,701 | A * | 4/2000 | Stone | F21V 21/08 362/249.11 |
| 6,224,231 | B1 | 5/2001 | Personius | |
| 6,254,250 | B1 | 7/2001 | Shieh | |
| 6,273,584 | B1 | 8/2001 | Wang et al. | |
| 6,334,694 | B1 | 1/2002 | Huang | |
| 6,458,435 | B1 | 10/2002 | Lai | |
| 6,652,927 | B1 | 11/2003 | Chen | |
| 6,663,921 | B1 | 12/2003 | Quigel | |
| 7,152,998 | B2 | 12/2006 | Rahman | |
| 7,563,000 | B2 | 7/2009 | Gierveld | |
| 8,087,796 | B2 | 1/2012 | Golembiowski | |
| 8,309,188 | B2 | 11/2012 | Cheng et al. | |
| 8,678,615 | B1 | 3/2014 | Ko | |

(Continued)

*Primary Examiner* — Laura K Tso
(74) *Attorney, Agent, or Firm* — Pitts & Lake, P.C.

(57) ABSTRACT

A device to be affixed to an extension pole to support string lights, the device including a base member, a receiving portion formed in a bottom of the base member and configured to receive an end of an extension pole, and a plurality of hook members extending laterally from the base member and curving upwards to form a receiving portion configured to receive and support a portion of string lights.

15 Claims, 6 Drawing Sheets

(56) References Cited

U.S. PATENT DOCUMENTS

| | | | | |
|---|---|---|---|---|
| 9,055,835 | B1 | 6/2015 | Rahman | |
| 9,523,486 | B2 * | 12/2016 | Boyink | F21V 23/02 |
| 9,945,523 | B2 | 4/2018 | Boyink | |
| 10,092,124 | B1 * | 10/2018 | Tsai | F21S 4/15 |
| 2012/0027961 | A1 * | 2/2012 | Fogle | A47G 33/0863 428/8 |
| 2018/0042421 | A1 * | 2/2018 | Bennett | A47G 33/10 |

* cited by examiner

STRING LIGHT SUPPORT DEVICE FOR PAINTER'S POLE

CROSS-REFERENCE TO RELATED APPLICATIONS

This application claims the benefit of U.S. Provisional Patent Application Ser. No. 62/797,675, filed on Jan. 28, 2019, which is incorporated herein in its entirety by reference.

FIELD OF INVENTION

The present general inventive concept relates to a support for string lights, and, more particularly, to a string lights support device that may be readily affixed to an end of a painter's pole.

BACKGROUND

Many people enjoy displaying outdoor decorations during holidays such as Christmas. One of the most popular outdoor decorations during such holidays is string lights, which can be arranged in a host of ways to provide color, spell out words, form figures, etc. However, since support for such string lights may be limited outside the home, it would be desirable to provide an easy and convenient way to affix string lights to objects that are either already on hand, or may be easily and cheaply obtained, such as a painter's pole.

BRIEF SUMMARY

According to various example embodiments of the present general inventive concept, a device is provided that has one or more hook members from which string lights can be hung, and which can be affixed to a painter's pole.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a device to be affixed to an extension pole to support string lights, the device including a base member, a receiving portion formed in a bottom of the base member and configured to receive an end of an extension pole, and a plurality of hook members extending laterally from the base member and curving upwards to form a receiving portion configured to receive and support a portion of string lights.

The foregoing and/or other aspects and advantages of the present general inventive concept may also be achieved by providing a device to be affixed to an extension pole to support string lights, the device including a base member that tapers outward from a top portion to a bottom portion, a receiving portion formed in the bottom portion of the base member and configured with an interior thread configured to register with a threaded end of an extension pole, a plurality of hook members extending laterally from the base member proximate the bottom portion and curving upwards to form a receiving portion configured to receive and support a portion of string lights, and a protruding portion extending upward from the top portion of the base member and formed with an exterior thread configured to register with the interior thread.

The foregoing and/or other aspects and advantages of the present general inventive concept may also be achieved by providing a device to be affixed to an extension pole to support string lights, the device including a base member having a flat portion on a rear of the base member, and a plurality of hook members provided at points of the base member other than the rear, the hook members extending laterally from the base member and curving upwards to form a receiving portion configured to receive and support a portion of string lights.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1A:
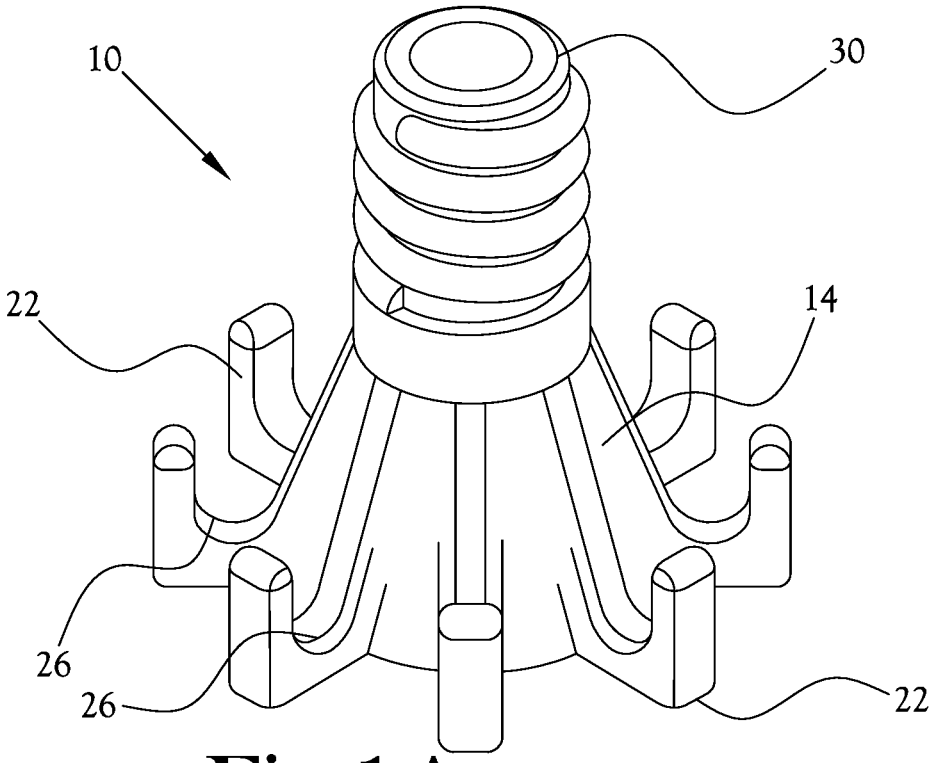
FIGS. 1A-B illustrate two different perspective views of a device to support string lights according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a string light supporting device is provided which allows a user to easily support various portions of a string of lights such that the lights may be arranged according to the user's wishes. The devices may be formed with one or more hook portions from which the string lights may be hung. The string light supporting device can affixed to an extension pole, examples of which may be referred to as a painter's pole. These extension poles typically have a threaded or other such coupling arrangement on at least one end thereof. In many instances, these extension poles have a "male" threaded coupling at one end, an opposite "female" coupling at the other end, and may have an adjustable length. For example, in many instances, the extension poles are telescopically adjustable, such that the overall length of the extension pole may be adjusted between a relatively shorter and relatively longer length. In several example embodiments, a first string light supporting device may be affixed to one end of the extension pole, while a second string light supporting device may be affixed to the other end of the extension pole. In this way, a first string light supporting device may act as a base receiver to rest on the ground or another object and support the extension pole in an upright position extending upwardly from the ground or other object. The second string light supporting device may then be carried and supported by the extension pole in a position elevated above the base receiver, such that one or more strings of lights may be extended between the ground or other object and the various hooks of the second string light supporting device, such that a "Christmas tree" shape may be formed with the string lights. In embodiments in which the length of the extension pole may be adjusted, the extension pole may be lengthened in order to establish tension along the string lights, thereby fixing and maintaining the string lights in the "Christmas tree" shape. In other example embodiments the string light support device may be just to couple two extension or painter's poles together to form a taller structure, and may also be used to create the aforementioned Christmas tree shape.

In various other example embodiments, the devices may be stacked one upon the other to form multiple layers of the support hooks. In various example embodiments the device may be formed such that the device is positionable along different points of the extension pole, such as by forming a receiving portion through which at least a portion of the extension pole passes through entirely. Such a configuration may be formed so as to provide a friction fit to a standard sized painter's pole. Thus, an attractive string light configuration can be formed around a structure that may be simply implemented by inserting an end of the extension pole into the ground, and affixing one or more of the light supporting devices to the top of the extension pole.

Figure 1B:
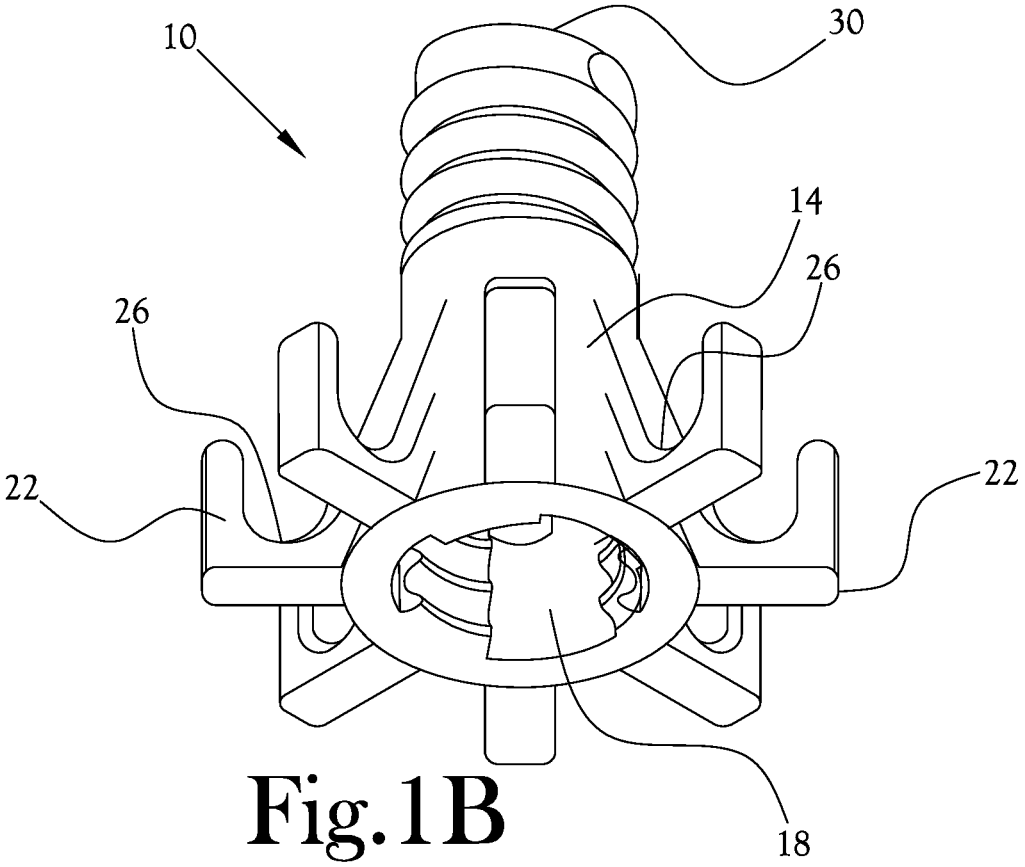
Figure 3:
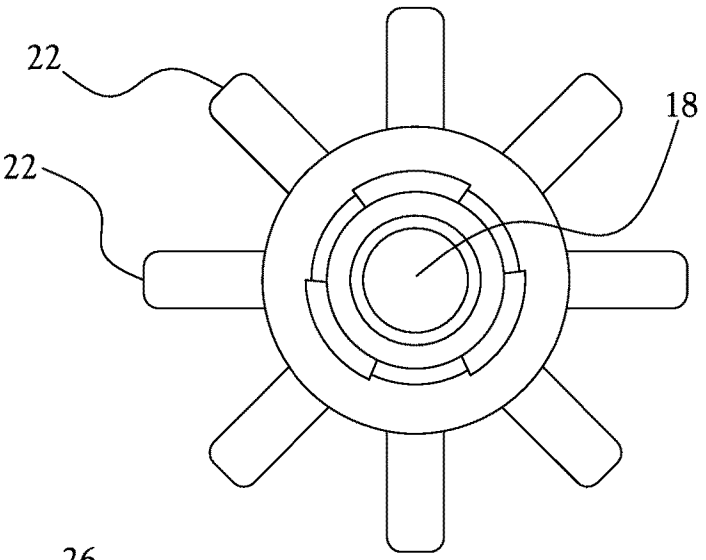
FIG. 3 illustrates a bottom view of the device of FIGS. 1A-B.
Figure 2:
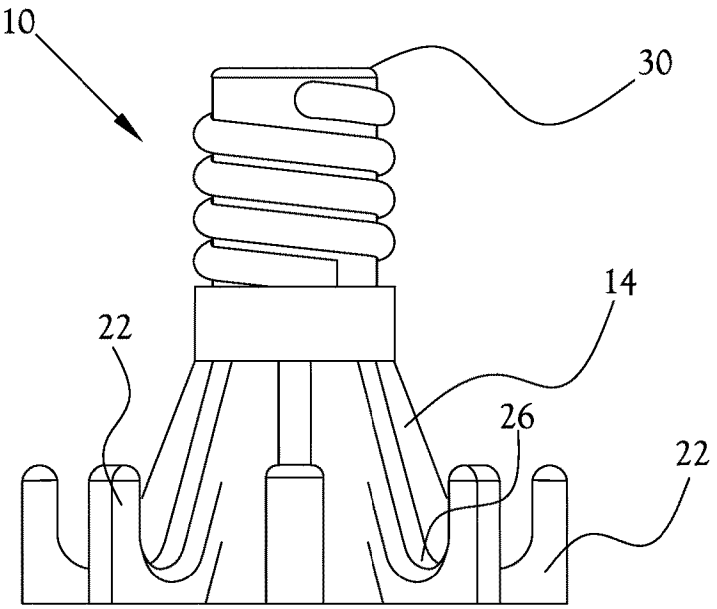
FIG. 2 illustrates a side view of the device of FIGS. 1A-B.
Figure 4:
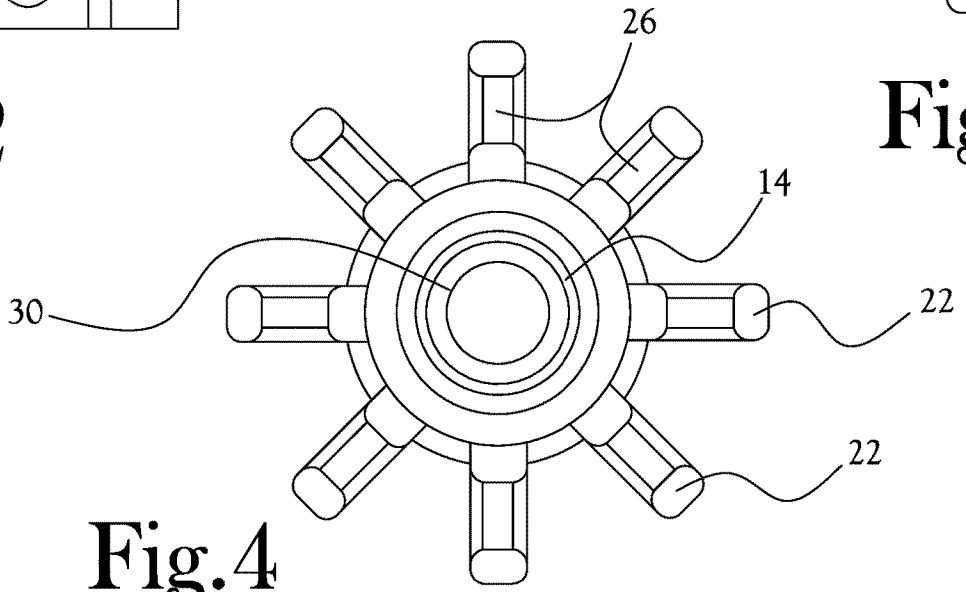
FIG. 4 illustrates a top view of the device of FIGS. 1A-B.

FIGS. 1A-B illustrate two different perspective views of a string light supporting device according to an example embodiment of the present general inventive concept. FIGS. 2-4 respectively illustrate side, bottom, and top views of the device illustrated in FIGS. 1A-B. In the example embodiment illustrated in these drawings, the string light supporting device 10 includes a base member 14, which may be referred to herein as a base or base portion, a receiving portion 18 formed in a bottom of the base 14, and a plurality of hook members 22 or support hooks extending from points around a perimeter of the base 14. The support hooks 22 of this example embodiment curve upward to provide respective receiving portions 26 to support string lights through simple gravitational force. In other words, a user can simply pass the string lights in the receiving portions 26 to hang therefrom. Although not illustrated in these drawings, in various example embodiments the receiving portions 26 may be configured to provide a host of other types of fits to more securely hold the portions of the string lights placed therein. For example, the receiving portions may be configured to form a friction fit on the cord of the string lights, a snapping fit that will close around the cord of the string lights, a hook that is formed to curve in toward itself to provide support to prevent the cord from slipping or blowing out in any one direction, and so on.

In various example embodiments the base member 14 may flare or taper outward from top to bottom, and the hooks 22 may be provided proximate the bottom of the base member 14. In various example embodiments the hooks 22 may be provided in an evenly spaced arrangement around the perimeter of the base member 14. The receiving portion 18 in the base member 14 may be threaded, fluted, or otherwise arranged to allow the device to be affixed to an end of the extension pole. In some example embodiments, the device 10 may be formed so that the pole can pass through the receiving portion and the device can then be situated as a desired portion on the pole. In other various example embodiments, the receiving portion 18 may be terminated proximate a top of the base 14, and a protruding member 30 or protruding portion extends upward from a top of the base member 14 to provide a male member that can be coupled to the female receiving member 18 of another of the devices, or of a female fitting of a painter's pole. The protruding member 30 may be threaded, fluted, etc., so as to correspond with the mating action of the receiving portion 18. With such a configuration, the devices 10 may be stacked atop one another at an end of the painter's pole to provide more support hooks at multiple levels, which would allow a user to form more intricate designs with the string light arrangements.

Figure 5:
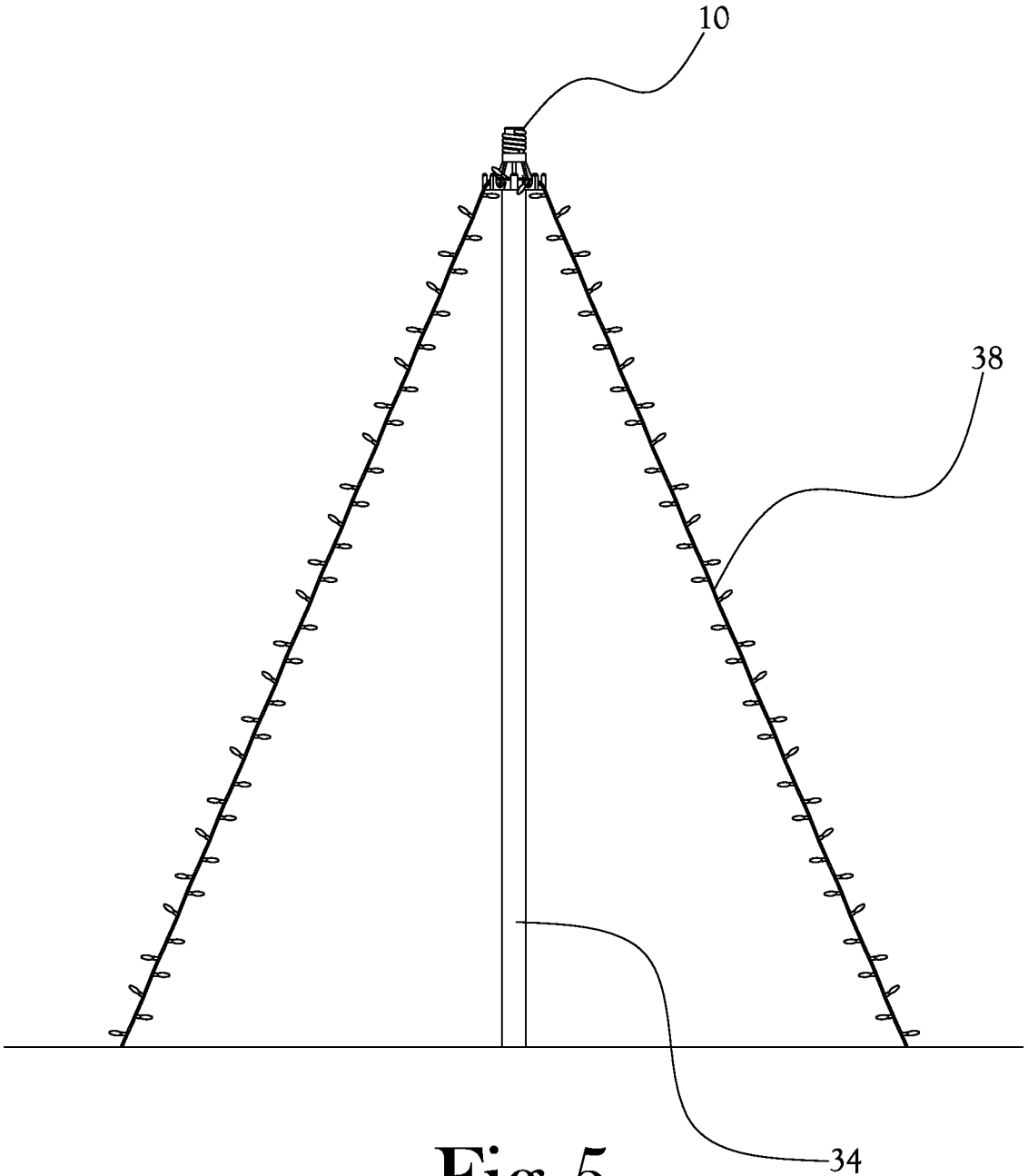
FIG. 5 illustrates the device of FIGS. 1A-B in an example mounting arrangement on a painter's pole.
Figure 6:
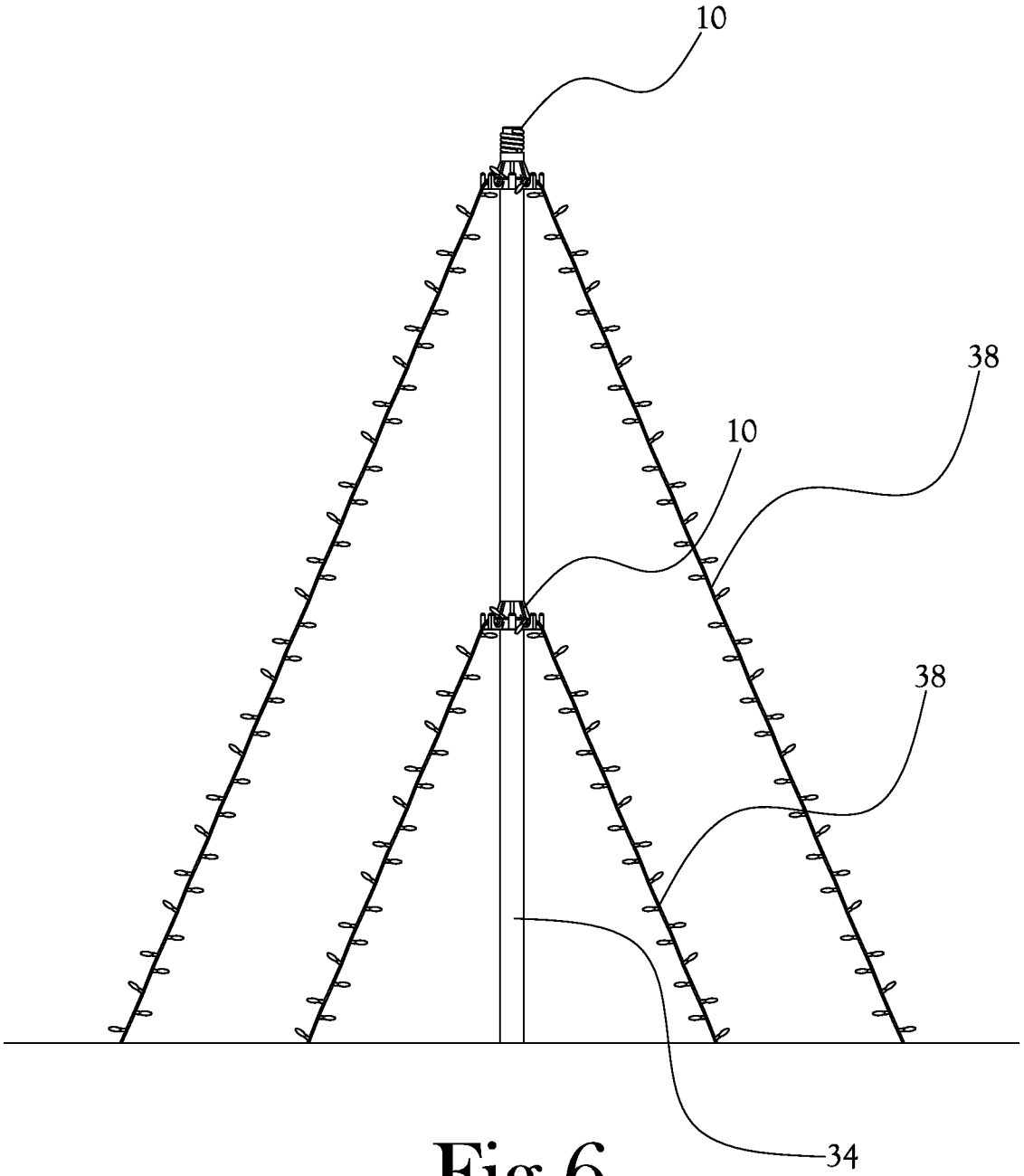
FIG. 6 illustrates two of the devices of FIGS. 1A-B in another example mounting arrangement on two painter's poles.
Figure 7:
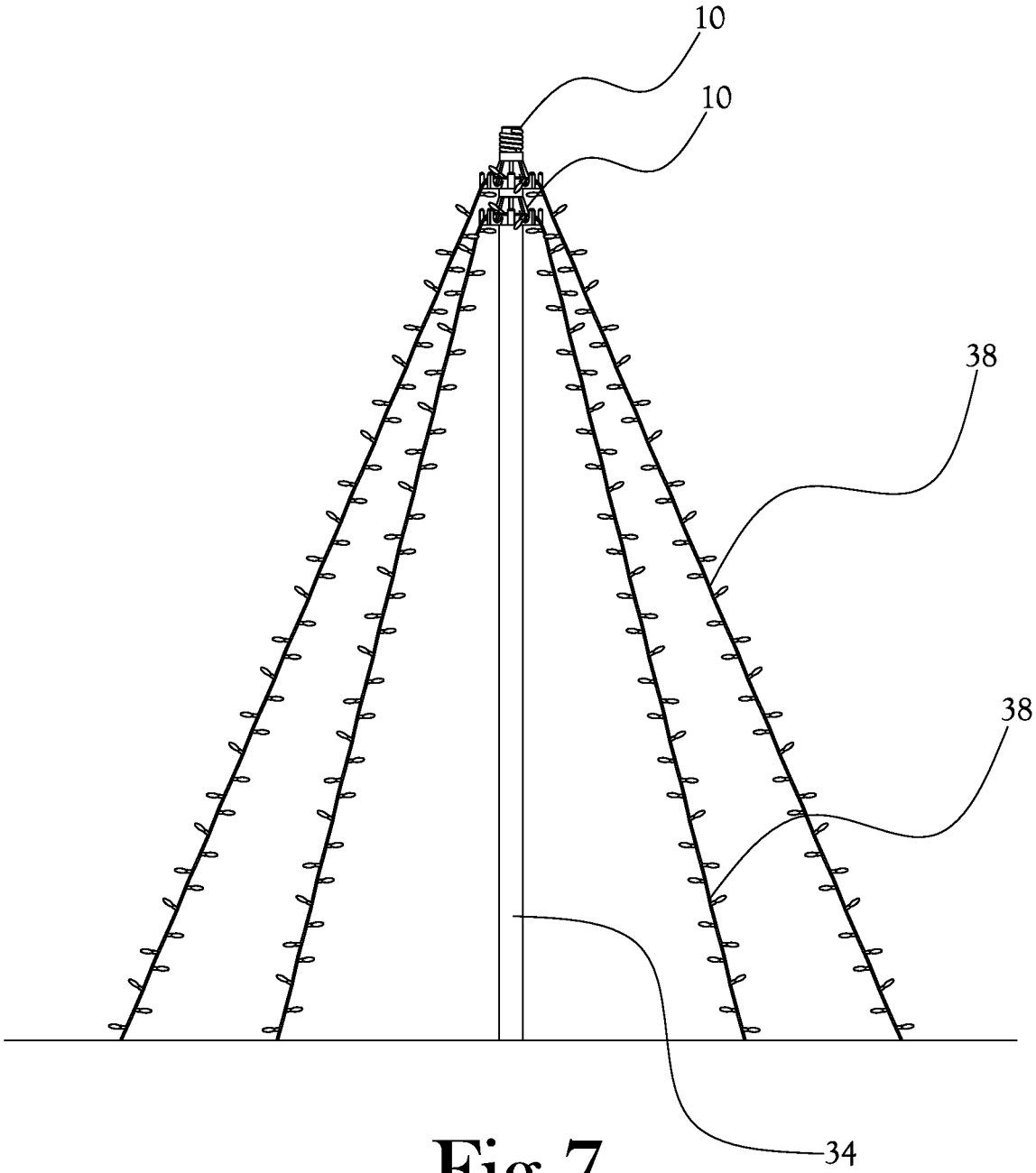
FIG. 7 illustrates two of the devices of FIGS. 1A-B in still another example mounting arrangement on a painter's pole.

As illustrated in FIGS. 5-7, one or more such devices can be affixed to the top and/or other portions of an extension pole to support string lights that are angled outward and downward to approximate the classic "Christmas tree" shape. It is noted that in these drawings the dimensions of the devices and poles, as well as their interconnecting portions, may be exaggerated for the sake of clarity. FIG. 5 illustrates the device 10 in an example mounting arrangement on a painter's pole 34. The device 10 is screwed or otherwise mounted on a top end of the painter's pole 34, the top end of the pole 34 being received in the receiving portion 18 in the bottom of the base member 14 of the device 10. Then one or more strings of string lights 38 are arranged so as to flare outward from the support device 10 to the ground in a substantially conical shape that resembles the shape of a Christmas tree. A variety of other shapes may also be configured with the sting lights 38. The string lights 38 may be anchored to the ground through any number of ways, including a plurality of the devices 10 that have been inverted and stuck in the ground such that the hook members 22 curve downward toward the ground. FIG. 6 illustrates two of the devices 10 in another example mounting arrangement on two painter's poles. In FIG. 6 a top end of a first painter's pole 34 has been inserted into the receiving portion 18 of a first light support device 10, and a top end of a second painter's pole 34 has been inserted into the receiving portion 18 of a second light support device 10. The top protruding portion 30 of the second light support device 10 is mounted in the bottom end of the first painter's pole 34, having a female fitting, to couple all of the first and second devices 10 and painter's poles 34 into one structure in which string lights 38 may be hung from top and mid portions of the structure. In various example embodiments such a structure may be formed with a single painter's pole 34 if the support device is formed so as to allow the painter's pole 34 to pass entirely therethrough, with the inner structure of at least the receiving portion being configured to form a friction fit on the painter's pole. FIG. 7 illustrates two of the devices 10 in still another example mounting arrangement on a painter's pole 34. As illustrated, the protruding portion 30 of a first device 10 is inserted into the receiving portion 18 of a second device 10, and the receiving portion 18 of the first device 10 is then placed over the top end of the painter's pole 34 to provide two rows of supporting hooks 22 in close proximity to one another at a top of the painter's pole. As seen from at least the configurations illustrated in these drawings, the structure of the devices is conducive to forming several different configurations of string light decorations.

Figure 8A:
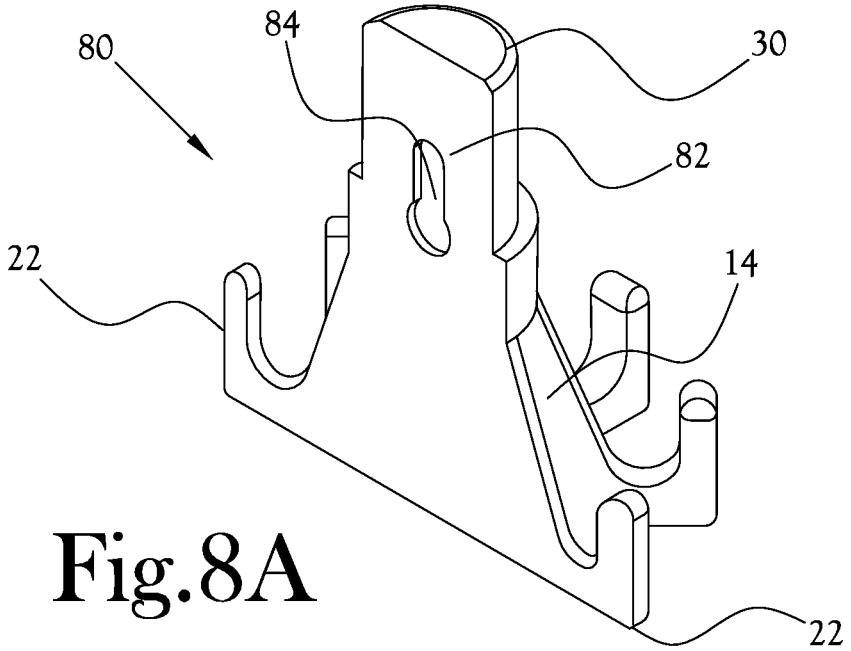
FIGS. 8A-B illustrate two different perspective views of a device to support string lights according to yet another example embodiment of the present general inventive concept.
Figure 8B:
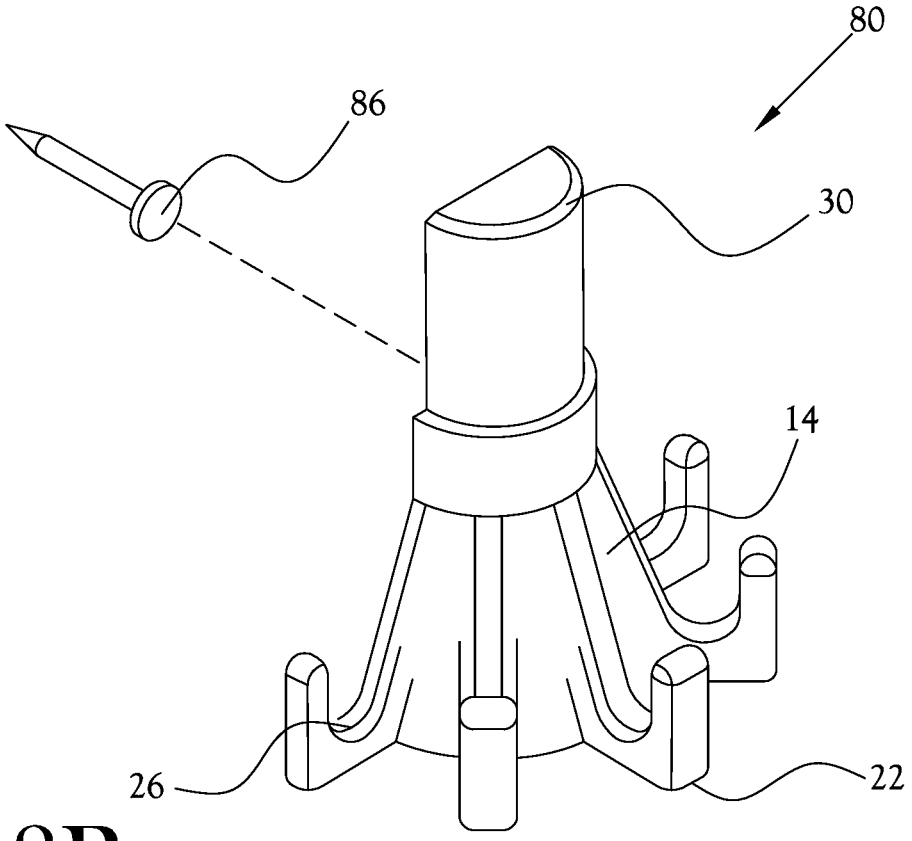

Various other configurations of string light supporting devices may be utilized without departing from the scope of the present general inventive concept. As an example, a string light supporting device may be configured to be attached to a wall or a side surface of some other structure, rather than being placed atop a painter's pole, so that string lights can be supported in different ways both indoors and outdoors. In various example embodiments such a device could be configured to resemble half of one of the previously described devices, divided along a longitudinal axis, with a notch or other type of hanging configuration on back to secure the device to a structural surface. FIGS. 8A-B illustrate two different perspective views of a device to support string lights according to yet another example embodiment of the present general inventive concept. The string light supporting device 80 of FIGS. 8A-B is configured to provide a plurality of hook members or support hooks 22 conveniently on a side surface such as an indoor wall, an outdoor post, and so on. As illustrated in FIGS. 8A-B, the string light supporting device 80 may be aesthetically similar on one side to the previously described example embodiments, but is provided with a flat portion 82 on a "rear side" of the device 80 that could rest flush or nearly flush against a wall or other substantially flat surface. The base member 14 of the device 80 is configured to taper outward from top to bottom except along the flat portion 82, and has a plurality of the support hooks 22 provided about the bottom of the tapered portion of the base member 14. Various quantities of the support hooks 22 may be provided according to various example embodiments of the present general inventive concept. With such a configuration, string lights may be supported by single support hooks 22 for each passing strand, or a strand can be supported by a plurality of the support hooks 22 at the same time. Although the protruding member 30 is illustrated in this embodiment as not being threaded, in various example embodiments the protruding member 30 may be threaded away from the flat portion 82 to match the appearance of other devices fitted atop painter's poles. Various example embodiments may forego the protruding member 30 completely. In the example embodiment illustrated in FIGS. 8A-B, the back flat portion 82 is provided along most of the rear surface, except for a mount opening 84 formed in the flat portion 82 and configured to receive a nail or other such device to mount the device 80 on a flat surface. The mount opening 84 is illustrated as being shaped to receive a nail 86 or screw head in the larger bottom portion thereof, and then slide down over the screw or nail 86 to secure the device 80 to the wall or other flat surface into which the screw or nail 86 has already been inserted. Various example embodiments may provide flat portions 82 that only cover partial portions of the back of the device 80, and the reset of the rear of the device 80 may be simply open to a hollow interior of the device 80. Various example embodiments may provide mounting members or portions that are not integrally formed with the flat portion 82, but are instead attached thereto, or may provided other attachment members such as adhesive bodies, etc. Various example embodiments may include string light receiving portions 26 that are configured to provide a friction fit or other such securing fit for the string lights, such as curling back toward the base 14, which would allow the device 80 to even be mounted horizontally on a flat surface such as the ceiling to allow string lights to be hung therefrom.

Various example embodiments of the present general inventive concept may provide a device to be affixed to an extension pole to support string lights, the device including a base member, a receiving portion formed in a bottom of the base member and configured to receive an end of an extension pole, and a plurality of hook members extending laterally from the base member and curving upwards to form a receiving portion configured to receive and support a portion of string lights. The respective hook members may extend from a position proximate the bottom of the base member. The hook members may be provided at positions surrounding the base member. The receiving portion may be threaded and configured to correspond to a threaded end of the extension pole. The receiving portion may be fluted to provide a friction fit for the end of the extension pole. The device may further include a protruding portion extending from a top of the base member, and configured to register with the receiving portion such that a plurality of the devices are selectively couplable by placing the protruding portion of a first one of the devices into the receiving portion of a second one of the devices. The protruding and receiving portions may be threaded or fluted. The receiving portion may be configured as a through hole that allows at least a portion of the extension pole to pass completely through the device. The receiving portion may be configured to form a friction fit with the extension pole so as to maintain a desired position on the extension pole with the friction fit. The hook members may be configured to provide a friction fit with the portion of string lights received therein.

Various example embodiments of the present general inventive concept may provide a device to be affixed to an extension pole to support string lights, the device including a base member that tapers outward from a top portion to a bottom portion, a receiving portion formed in the bottom portion of the base member and configured with an interior thread configured to register with a threaded end of an extension pole, a plurality of hook members extending laterally from the base member proximate the bottom portion and curving upwards to form a receiving portion configured to receive and support a portion of string lights, and a protruding portion extending upward from the top portion of the base member and formed with an exterior thread configured to register with the interior thread.

Various example embodiments of the present general inventive concept may provide a device to be affixed to an extension pole to support string lights, the device including a base member having a flat portion on a rear of the base member, and a plurality of hook members provided at points of the base member other than the rear, the hook members extending laterally from the base member and curving upwards to form a receiving portion configured to receive and support a portion of string lights. The device may further include a mount opening formed in the flat portion and configured to receive a mounting member. The mount opening may be configured to receive a head of the mounting member and then slide over a body of the mounting member. The mounting member may be a nail or screw or other such attachment member. The flat portion may extend across all of the rear of the base member except for the mount opening.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A device to be affixed to an extension pole to support string lights, the device comprising:

a base member;

a receiving portion formed in a bottom of the base member and configured to receive an end of an extension pole;

a plurality of hook members extending laterally from the base member and curving upwards to form a receiving portion configured to receive and support a portion of string lights; and a protruding portion extending from a top of the base member, and configured to register with the receiving portion such that a plurality of the devices are selectively couplable by placing the protruding portion of a first one of the devices into the receiving portion of a second one of the devices.

2. The device of claim 1, wherein the respective hook members extend from a position proximate the bottom of the base member.

3. The device of claim 1, wherein the hook members are provided at positions surrounding the base member.

4. The device of claim 1, wherein the receiving portion is threaded and configured to correspond to a threaded end of the extension pole.

5. The device of claim 1, wherein the receiving portion is fluted to provide a friction fit for the end of the extension pole.

6. The device of claim 1, wherein the protruding and receiving portions are threaded or fluted.

7. The device of claim 1, wherein the receiving portion is configured as a through hole that allows at least a portion of the extension pole to pass completely through the device.

8. The device of claim 7, wherein the receiving portion is configured to form a friction fit with the extension pole so as to maintain a desired position on the extension pole with the friction fit.

9. The device of claim 1, wherein the hook members are configured to provide a friction fit with the portion of string lights received therein.

10. A device to be affixed to an extension pole to support string lights, the device comprising:

a base member that tapers outward from a top portion to a bottom portion;

a receiving portion formed in the bottom portion of the base member and configured with an interior thread configured to register with a threaded end of an extension pole;

a plurality of hook members extending laterally from the base member proximate the bottom portion and curving upwards to form a receiving portion configured to receive and support a portion of string lights; and a protruding portion extending upward from the top portion of the base member and formed with an exterior thread configured to register with the interior thread.

11. A device to support string lights, the device comprising:

a base member having a flat portion on a rear side of the base member, the rear side configured to rest against a substantially flat surface; and a plurality of hook members provided at points about the base member other than the rear side, the hook members extending laterally from the base member and curving upwards to form a receiving portion configured to receive and support a portion of string lights.

12. The device of claim 11, further comprising a mount opening formed in the flat portion and configured to receive a mounting member.

13. The device of claim 12, wherein the mount opening is configured to receive a head of the mounting member and then slide over a body of the mounting member.

14. The device of claim 12, wherein the mounting member is a nail or screw.

15. The device of claim 12, wherein the flat portion extends across all of the rear side of the base member except for the mount opening.

* * * * *